US005356443A

United States Patent [19]

Reinert et al.

[11] Patent Number: 5,356,443

[45] Date of Patent: Oct. 18, 1994

[54] STABILIZATION OF DYEINGS OF POLYAMIDE FIBRES

[75] Inventors: Gerhard Reinert, Allschwil; Thys Bouwknegt, Reinach; Francesco Fuso, Therwil, all of Switzerland

[73] Assignee: Ciba-Geigy Corporation, Ardsley, N.Y.

[21] Appl. No.: 117,847

[22] Filed: Sep. 7, 1993

[30] Foreign Application Priority Data

Sep. 8, 1992 [CH] Switzerland ..... 2802/92-1

[51] Int. Cl.[5] ..... D06P 5/02; D06M 13/438; D06M 13/256

[52] U.S. Cl. ..... 8/586; 8/442; 8/490; 8/566; 8/573

[58] Field of Search ..... 8/586, 442, 490, 560, 8/573

[56] References Cited

U.S. PATENT DOCUMENTS 3,665,031 5/1992 Peterli et al. ..... 260/507
5,057,562 10/1991 Reinert ..... 8/442
5,069,681 12/1991 Bouwknegt et al. ..... 8/442
5,074,885 12/1991 Reinert ..... 8/442
5,096,456 3/1992 Reinert et al. ..... 8/442
5,181,935 1/1993 Reinert et al. ..... 8/442

FOREIGN PATENT DOCUMENTS 335404 10/1989 European Pat. Off. .

*Primary Examiner*—Arthur C. Prescott
*Attorney, Agent, or Firm*—George R. Dohmann

[57] ABSTRACT

A process for enhancing the thermal and/or photochemical stability of dyeings on dimensionally stabilised polyamide fibres, which comprises treating the polyamide fibre material, before the fixation step for producing defined, resilient forms and dimensions, in aqueous medium with a compound of formula I $$(A\text{-}Y\text{-})_n Z(\text{-}W)_m \quad (1)$$

wherein A, W, Y, Z, n and m are as defined in claim 1.

12 Claims, No Drawings

STABILIZATION OF DYEINGS OF POLYAMIDE FIBRES

The present invention relates to a process for enhancing the thermal and/or photochemical stability of dyeings on dimensionally stabilised polyamide fibres, as well as to the polyamide fibre material treated by said process.

Polyamide fibre materials are thermally and photochemically sensitive and can be damaged by exposure to light and or heat.

The damage is normally caused during a finishing step, typically in the course of dimensional stabilisation or area stabilisation, dyeing, in a moulding process, as well as in the curing of textile finishes or coats.

In U.S. Pat. No. 3,665,031 it is taught to protect undyed polymers such as polyamides from the action of heat and/or oxygen (air oxidation) using water-soluble phenolic antioxidants.

It is the object of the present invention to diminish the thermal and/or photochemical instability of fixed polyamide fibre materials to achieve superior lightfastness properties and good ageing resistance.

Polyamide fibre materials, especially piece goods and, most particularly, yarns, are usually fixed to produce defined resilient forms and dimensions. Fixation is effected by a heat treatment, typically steaming at high temperature or by a pure heat treatment, q.v. K. D. Kroh in Chemiefasem/rextilindustrie, July/August 1979, pp. 518–524 und 599–602. After the fixation of piece goods and the processing of yarns, the finishing process of the polyamide fibre material is then carded out, typically dyeing.

It has now been found that the thermal and/or photochemical instability of polyamide fibre materials can be wholly, or at least substantially, eliminated by treating the undyed polyamide fibre materials with phenolic water-soluble antioxidants before the fixation step for producing defined, resilient forms and dimensions.

Accordingly, the invention relates to a process for enhancing the thermal and/or photochemical stability of dyeings on dimensionally stabilised polyamide fibres, which comprises treating the polyamide fibre material, before the fixation step for producing defined, resilient forms and dimensions, from aqueous medium with a compound of formula I $$(A—Y—)_nZ(—W)_m \quad (1)$$

wherein

A is the radical of a sterically hindered phenol of the benzene series,

Y is a radical of formulae (2) or (3)

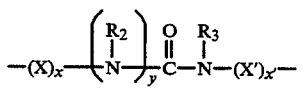

(2)

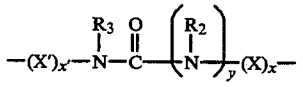

(3)

wherein

X and X′ are each independently of the other alkylene, oxaalkylene or thiaalkylene, $R_2$ and $R_3$ are each independently of the other hydrogen or an unsubstituted or substituted alkyl group, and x, x′ and y are each independently of one another 0 or 1, Z is an aliphatic or a carbocyclic aromatic radical, which last mentioned radical contains not more than two mono- or bicyclic nuclei, W is the sulfo group, and m and n are each independently of the other 1 or 2, and the water-soluble salts thereof.

A in formula (1) is typically a monohydroxyphenyl radical in which at least one o-position relative to the hydroxyl group is substituted by an alkyl, a cycloalkyl or an aralkyl group, and which may carry further substituents.

Alkyl groups in o-position relative to the hydroxyl group of A may be straight-chain or branched and contain 1 to 12, preferably 4 to 8 carbon atoms. α-Branched alkyl groups are preferred. Illustrative examples of such groups are methyl, ethyl, isopropyl, tertbutyl, isoamyl, octyl, tert-octyl and dodecyl. Tert-butyl is especially preferred.

Cycloalkyl groups in o-position relative to the hydroxyl group of A contain 6 to 10, preferably 6 to 8 carbon atoms. Exemplary of such groups are cyclohexyl, methylcyclohexyl and cyclooctyl.

Aralkyl groups in o-position relative to the hydroxyl group of A contain 7 to 10, preferably 8 to 9 carbon atoms. Typical examples of such aralkyl groups are α-methylbenzyl and α,α-dimethylbenzyl.

The radical A may additionally carry further alkyl, cycloalkyl or aralkyl groups as defined above, which groups are preferably in o′- or p-position relative to the hydroxyl group, provided these positions are not occupied by the bond to Y. It is also advantageous that at least one m-position relative to the hydroxyl group is unsubstituted, whereas the others may be substituted by lower alkyl groups such as the methyl group.

Owing to the ease with which they can be obtained and their useful stabilising action, compounds of formula (1) are especially preferred wherein A is a radical of formula (4)

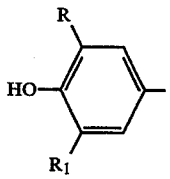

(4)

wherein

R and $R_1$ are each independently of the other hydrogen, methyl or tert-butyl, and the sum of the carbon atoms of R and $R_1$ is at least 2.

X and X′ in formulae (2) and (3) may be straight-chain or branched and contain 1 to 8, preferably 1 to 5, carbon atoms. Typical examples of such groups are methylene, ethylene, trimethylene, propylene, 2-thiatrimethylene or 2-oxapentamethylene.

Compounds in which two hetero atoms in X and X′ are not attached to the same saturated, i.e. tetrahedral, carbon atom, are especially preferred.

Alkyl groups $R_2$ or $R_3$ in formulae (2) and (3) may be straight-chain or branched and contain 1 to 18, preferably 1 to 8, carbon atoms. Illustrative examples of such alkyl groups are methyl, ethyl, isopropyl, pentyl, octyl, dodecyl and octadecyl.

Substituted alkyl groups $R_2$ or $R_3$ are typically hydroxyalkyl, alkoxyalkyl, aminoalkyl, alkylaminoalkyl or dialkylaminoalkyl of altogether 2 to 10, preferably 2 to 5 carbon atoms. Illustrative examples are β-hydroxyethyl, β-methoxyethyl, β-aminoethyl, β,β'-diethylaminoethyl or β-butylaminoethyl.

$R_2$ or $R_3$ may also be an aryl group, preferably the phenyl group.

Particularly preferred compounds of formula (1) are those wherein Y is a radical of formula (5)

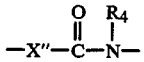

(5)

which $R_4$ is hydrogen or $C_1$–$C_4$alkyl and X'' is $C_1$–$C_4$alkylene.

Z in formula (1) may be the radical of an unsubstituted or carboxy-substituted lower alkane which contains at least two carbon atoms, the radical of a benzene nucleus which is unsubstituted or substituted by chloro or bromo, $C_1$–$C_4$alkyl, $C_1$–$C_4$alkoxy, $C_1$–$C_4$alkoxycarbonylamino, hydroxyl, carboxy, phenylethyl, styryl, phenyl, phenoxy, phenylthio, phenylsulfonyl or acylamino, and the group W can be attached direct to said benzene nucleus or to a monocyclic aryl radical of one of the substituents of said nulceus, or Z is a naphthalene or tetraline radical.

Z as a radical of a lower alkane may be straight-chain or branched and contain 2 to 5, preferably 2, carbon atoms. Z is therefore typically ethylene, propylene, trimethylene or pentamethylene. This radical may be additionally substituted by carboxyl groups and may typically be the carboxyethylene radical.

Z as the radical of a benzene nucleus in formula (1) may be further substituted. It may typically contain straight-chain or branched $C_1$–$C_4$alkyl radicals and be substituted e.g. by a methyl, ethyl or isopropyl group, preferably by the methyl group. Illustrative examples of $C_1$–$C_4$alkoxy groups as substituents of Z as the radical of a benzene nucleus are the methoxy, ethoxy or butoxy group. The acyl radical of Z as the radical of a benzene nucleus which is substituted by an acylamino group is preferably derived from a $C_2$–$C_6$aliphatic or a monocarboxylic aromatic carboxylic acid. Illustrative examples of such a radical are the radical of acetic, propionic, β-methoxypropionic, benzoic, aminobenzoic or methylbenzoic acid. Exemplary of $C_1$–$C_4$alkoxycarbonylamino groups as substituents of a benzene nucleus Z are the methoxy, ethoxy or butoxycarbonylamino radical.

Phenylethyl, styryl, phenyl, phenoxy, phenylthio or phenylsulfonyl groups as substituents of the group Z may be unsubstituted or chloro- or bromo-substituted $C_1$–$C_4$alkyl groups such as methyl or ethyl, $C_1$–$C_4$alkoxy such as methoxy, acylamino such as acetylamino or benzoylamino, or alkoxycarbonylamino such as methoxycarbonylamino or ethoxycarbonylamino.

Two or more identical or different substituents of Z as the radical of a benzene ting or of the aryl-containing substituents thereof may be present simultaneously.

Z as a naphthalene radical may be unsubstituted or substituted by $C_1$–$C_4$alkyl or $C_1$–$C_4$alkoxy groups, typically methyl or methoxy.

The sulfo group W in formula (1) is preferably free, but may also be in the form of its alkali salts or alkaline earth metal salts, of the ammonium salt or of salts or organic nitrogen bases. Owing to the low solubility of certain calcium, strontium and barium salts in aqueous media and for economic reasons, compounds of formula (1) are preferred in which the group W is present in the form of its lithium salt, sodium salt, potassium salt, magnesium salt or ammonium salt, or as an ammonium salt of an organic nitrogen base the cation of which has the formula (6)

$$+/NR'R''R'''R'''' \quad (6)$$

wherein R', R'', R''', R'''' are each independently of one another hydrogen, $C_1$–$C_4$alkyl or β-hydroxy-$C_1$–$C_4$alkyl or cyclohexyl, at least two of which radicals can form a carbo- or heterocyclic ring system with one another.

Typical examples of organic nitrogen bases which can form ammonium salts of this type with the group W are trimethylamine, triethylamine, triethanolamine, diethanolamine, ethanolamine, cyclohexylamine, dicyclohexylamine, hexamethyleneimine or morpholine.

Compounds of formula (7)

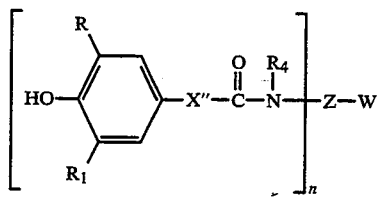

(7)

have a particularly useful stabilising effect.

In this formula, R and $R_1$ are each independently of the other methyl or tert-butyl, $R_4$ is hydrogen or $C_1$–$C_4$alkyl, X'' is $C_1$–$C_4$alkylene, Z is ethylene, a di- or trivalent radical of benzene or naphthalene or a divalent radical of diphenyl ether, W is a sulfo group and n is 1 or2.

These compounds may contain the group W in the free form or also in the form of its salts defined above.

The water-soluble compounds of formula (1) are known, inter alia from U.S. Pat. No. 3 665 031, and can be prepared by methods known per se, for example by reacting n mol of a compound of formula (8)

$$A\text{-}(X)_x\text{-}P \quad (8)$$

with 1 tool of a compound of formula (9)

$$[W\ddagger_m Z\ddagger(X')_{x'}-Q]_n, \quad (9)$$

in which formulae one of P and Q is the group -NH-$R_3$, the other is the group

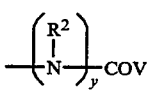

V, where y is 1, is the group -OAr, or where y is 0, is a chlorine or bromine atom or a reactive amino group, Ar is an aromatic radical of the benzene or naphthalene series and A, Z, W, $R_2$, X, X', x, m, n and y are as defined above, with elimination of HV.

Illustrative examples of starting materials of formula (10)

$$A-(X)_x-NH-R_3 \quad (10)$$

wherein A, X, x and $R_3$ are as defined above, which fall under formula (8) and are suitable for preparing the water-soluble compounds of this invention are: 4-hydroxy-3,5-di-tert-butylaniline, 4-hydroxy-3,5-di-tert-butylbenzylamine, γ-(4-hydroxy-3,5-di-tert-butylphenyl)propylamine, 4-hydroxy-3-tert-butyl-5-methylaniline, 4-hydroxy-3,5-dicyclohexylaniline, 4-hydroxy-3,5-di-tert-amylaniline, 4-hydroxy-3,5-dicyclohexylbenzylamine, 4-hydroxy-3-methylcyclohexyl-5-methylaniline, 2-hydroxy-3-α,α-dimethylbenzyl-5-methylbenzylamine, 4-hydroxyo3,5-dibenzylaniline, γ-(4-hydroxy-3,5-dibenzylphenyl)propylamine, 2-hydroxy-3-tert-butyl-5-dodecylaniline, 4-hydroxy-3-tert-octyl-5-methylbenzylamine, 4-hydroxy-3,5-diisopropylbenzylamine, 4-hydroxy-3-tert-butyl-6-methylbenzylanfine, 4-hydroxy-3,5-di-tert-amylbenzylamine, 2- hydroxy-3,5-dimethylaniline and 2-hydroxy-3-tert-butyl-5-methylbenzylamine.

Illustrative examples of starting materials of formula (11)

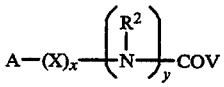

(11)

in which A, X, x, $R_2$, y and V are as defined above, which fall under formula (8) are: β-(4-hydroxy-3,5-di-tert-butylphenyl)-propionyl chloride, 4-hydroxy-3,5-di-tert-butylphenylacetyl chloride, 4-hydroxy-3,5-di-tert-butyl benzoyl chloride, 4-hydroxy-3-tertbutyl-5-methylphenylacetyl chloride, 2-hydroxy-3,5-dimethylbenzoyl chloride, 2-hydroxy-3-tert-butyl-5-methylbenzoyl chloride, S-(4-hydroxy-3-tert-butyl-5-methylbenzyl)thioglycolyl chloride, 4-hydroxy-5-tert-butylphenylacetyl chloride, β-(4-hydroxy3,5-dicyclohexylphenyl)propionyl bromide, (4-hydroxy-3,5-dicyclohexylphenyl)propionyl bromide, (4-hydroxy-3,5-dicyclohexylphenyl)acetylchloride, β-(4-hydroxy-3-benzyl-5-methylphenyl)propionyl chloride, (4-hydroxy-3-benzyl-5-methylphenyl)acetyl chloride, 4-hydroxy- 3,5-dioisopropylphenylacetyl chloride, S-(4-hydroxy-3,5-diisopropylbenzyl)thioglycolyl chloride, β-[ω-(4-hydroxy-3,5-di-tert-butylphenyl)propyloxy]propionyl chloride, [ω-(4-hydroxy-3,5-di-tertbutylphenyl)-propyloxy]acetyl chloride, β-methyl-β-(4-hydroxy-3,5-di-tert-butylphenyl)propionyl chloride, 4-hydroxy-3,5-di-tert-amylbenzyloxyacetyl chloride, and 4-hydroxy-5-tert-butyl-3-ethylbenzyloxyacetyl chloride.

Illustrative examples of starting materials of formula (12)

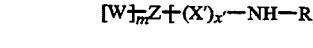

(12)

wherein W, m, Z, X', x', $R_3$ and n are as defined above, which fall under formula (9), are: 2-aminobenzenesulfonic acid, 3-aminobenzenesulfonic acid, 4-aminobenzenesulfonic acid, 5-chlor-2-aminobenzenesulfonic acid, 5-methyl-4-chloro-2-aminobenzenesulfonic acid, 2-chloro-5-aminobenzenesulfonic acid, 4-chloro-3-aminobenzenesulfonic acid, 5-chlor-3-methyl-3-aminobenzenesulfonic acid, 2,5-dichloro-4-aminobenzenesulfonic acid, 3-bromo-6-aminobenzenesulfonic acid, 3,4-dichloro-6-aminobenzenesulfonic acid, 1-aminotetraline-4-sulfonic acid, 1-aminobenzene-2,5-disulfonic acid, 1-aminobenzene-2,4-disulfonic acid, 1,3-diaminobenzene-4-sulfonic acid, 1,4-diaminobenzene-2-sulfonic acid, 2-amino-5-methylbenzenesulfonic acid, 5-amino-2,4-dimethylbenzenesulfonic acid, 4-amino-2-methylbenzenesulfonic acid, 3-amino-5-isopropyl-2-methylbenzenesulfonic acid, 2-amino-4,5-dimethylbenzenesulfonic acid, 2-amino-4,5-dimethoxybenzenesulfonic acid, 5-amino-2-methylbenzenesulfonic acid, 2-amino-5-ethylbenzenesulfonic acid, 1-aminonaphthalene-3-sulfonic acid, 1-aminonaphthalene-4-sulfonic acid, 1-aminonaphthalene-5-sulfonic acid, 1-aminonaphthalene-6-sulfonic acid 1-aminonaphthalene-7-sulfonic acid, 1-aminonaphthalene-8-sulfonic acid, 2-aminonaphthalene-1-sulfonic acid, 2-amino-naphthalene-5-sulfonic acid, 2-aminonaphthalene-6-sulfonic acid, 1-aminonaphthalene-3,6-disulfonic acid, 1-amino-naphthalene-3,8-disulfonic acid, 2-aminonaphthalene-4,8-disulfonic acid, 1,4-diaminonaphthalene-6-sulfonic acid, 3-amino-4-methoxybenzenesulfonic acid, 1-amino-2-methoxynaphthalene-6-sulfonic acid, 3-amino-4-hydroxybenzenesulfonic acid, 3-amino-6-hydroxybenzene-1,5-disulfonic acid, 2-amino-5-hydroxynaphthalene-7-sulfonic acid, 2-acetamido-5-aminobenzenesulfonic acid, 2-amino-5-(p-aminobenzoylamino)benzenesulfonic acid, 2-aminonaphthalene-5,7-disulfonic acid, 2-aminonaphthalene-6,8-disulfonic acid, 2- amino-5 -benzamidobenzene sulfonic acid, 4,4'-diamino-2,2'-disulfodiphenyl thioether, 2-amino-4-carboxy-5-chlorobenzenesulfonic acid, 4-amino-3-carboxybenzenesulfonic acid, 5-amino-3-sulfosalicylic acid, 2-([3-phenylethyl)-5-amino-benzenesulfonic acid, 1,2-bis[4-amino-2-sulfophenyl]ethane, 4,4'-diaminostilbene-2;2'-disulfonic acid, 4-aminostilbene-2-sulfonic acid, 4,4'-diamino-2'-methoxystilbene-2-sulfonic acid, 4-amino-3-sulfodiphenyl ether, 2-amino-4-sulfodiphenyl ether, 2-amino2'-methyl-4- sulfodiphenyl ether, 2- amino-4-chloro-4'- amyl-5-sulfodiphenyl ether, 2-amino-4,4'-dichloro-2'-sulfodiphenyl ether, 2-amino-4-methyl-4-sulfodiphenyl sulfone, 2,5-diamino-2'-methyl-4-sulfodiphenyl ether, benzidine-2,2'-disulfonic acid, 3,3'-dimethylbenzidine-6-sulfonic acid, benzidine-2-sulfonic acid, 2'-amino-3-sulfodiphenyl sulfone, 5'-amino-2'-methyl-3-sulfodiphenyl sulfone, 2',5'-diamino-4-methyl-3-sulfodiphenyl sulfone, 3'-amino-4'-hydroxy-3-sulfodiphenyl sulfone, 3,3'-diamino-4,4'-disulfodiphenyl sulfone, N-ethylanilin-4-sulfonic acid, N-methyl-2-naphthylamine-7-sulfonic acid, 2-aminoethanesulfonic acid, N-methyl-, -ethyl-, -propyl-, -isopropyl-, -amyl-, -hexyl-, -cyclohexyl-, -octyl-, -phenyl-, -dodecyl- or -stearyl-2-aminoethanesulfonic acid, 2-methyl-2-aminoethanesulfonic acid, ω-aminopropanesulfonic acid, ω-aminobutanesulfonic acid, ω-aminopentanesulfonic acid, N-methyl-δ-aminopropanesulfonic acid, 1,2-diaminoethanesulfonic acid, 2-methylaminopropanesulfonic acid and 2-amino-2-carboxyethanesulfonic acid.

Illustrative examples of starting materials of formula (13)

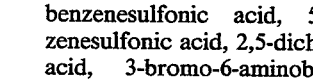

(13)

in which W, m, Z, X', x', $R_2$, y, V and n are as defined above, which fall under formula (9), are: 2-sulfobenzoyl chloride, 3-sulfobenzoyl chloride, 4-sulfobenzoyl chloride, 3,5-disulfobenzoyl chloride, 3-sulfophthaloyl chloride, 3,4-disulfophthaloyl chloride, 4-sulfophenylacetyl chloride, β-(4-sulfophenyl)propionyl chloride, 3-sulfo-6-methylbenzoyl chloride.

Some of the above mentioned starting materials are known and can be prepared by methods known per se.

The preparation of the compounds of the formula (1) usable according to the invention is described in more detail in U.S. Pat. No. 3,665,031.

Compounds of formula (1) suitable for use in the practice of this invention are e.g. compounds of formula

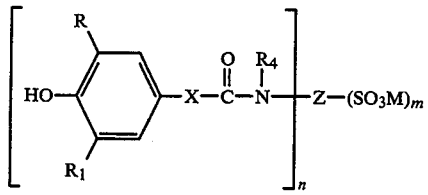

(14)

wherein R, $R_1$, $R_4$, X, Z, M, m and n have the following meanings.

TABLE 1
| Compound No. | R | $R_1$ | X | $R_4$ | Z-$SO_3M$ | M | m/n | m.p. °C. | $\lambda_{max}$ nm |
|---|---|---|---|---|---|---|---|---|---|
| 1 | $tertC_4H_9$ | $tertC_4H_9$ | $C_2H_4$ | H | 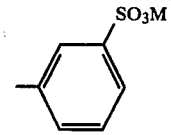 | H | 1/1 | >200 | 242 |
| 2 | $tertC_4H_9$ | $tertC_4H_9$ | $C_2H_4$ | H | 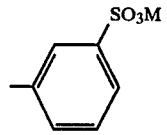 | Na | 1/1 | | 242 |
| 3 | $tertC_4H_9$ | $tertC_4H_9$ | $C_2H_4$ | H | 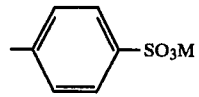 | H | 1/1 | 190 | 254 |
| 4 | $tertC_4H_9$ | $tertC_4H_9$ | $C_2H_4$ | H | 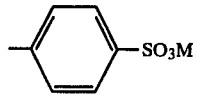 | Na | 1/1 | | 254 |
| 5 | $CH_3$ | $tertC_4H_9$ | $C_2H_4$ | H | 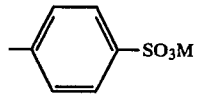 | H | 1/1 | | 254 |
| 6 | $tertC_4H_9$ | $tertC_4H_9$ | $C_2H_4$ | H | 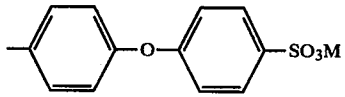 | H | 1/1 | >220 | 250 |
| 7 | $tertC_4H_9$ | $tertC_4H_9$ | $C_2H_4$ | H | 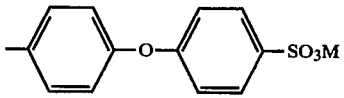 | Na | 1/1 | | |
| 8 | $tertC_4H_9$ | $tertC_4H_9$ | $C_2H_4$ | H | 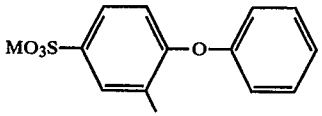 | H | 1/1 | | |

TABLE 1-continued
| Compound No. | R | $R_1$ | X | $R_4$ | Z-$SO_3M$ | M | m/n | m.p. °C. | $\lambda_{max}$ nm |
|---|---|---|---|---|---|---|---|---|---|
| 9 | $tertC_4H_9$ | $tertC_4H_9$ | $C_2H_4$ | H | 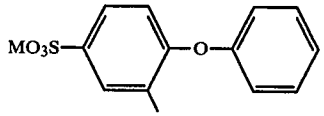 | Na | 1/1 | | |
| 10 | $tertC_4H_9$ | $tertC_4H_9$ | $C_2H_4$ | H | 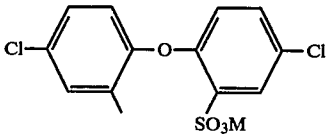 | H | 1/1 | 198 | 282 |
| 11 | $tertC_4H_9$ | $tertC_4H_9$ | $C_2H_4$ | H | 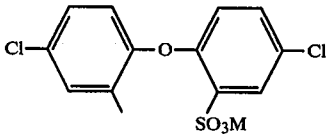 | Na | 1/1 | | |
| 12 | $tertC_4H_9$ | $tertC_4H_9$ | $C_2H_4$ | H | 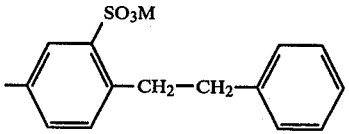 | H | 1/1 | 100 | 251 |
| 13 | $tertC_4H_9$ | $tertC_4H_9$ | $C_2H_4$ | H | 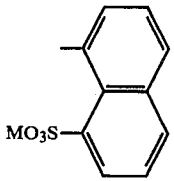 | H | 1/1 | >200 | 298 |
| 14 | $tertC_4H_9$ | $tertC_4H_9$ | $C_2H_4$ | H | 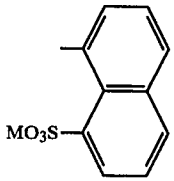 | Na | 1/1 | | |

TABLE 1-continued
| Compound No. | R | $R_1$ | X | $R_4$ | Z-$SO_3M$ | M | m/n | m.p. °C. | $\lambda_{max}$ nm |
|---|---|---|---|---|---|---|---|---|---|
| 15 | $tertC_4H_9$ | $tertC_4H_9$ | $C_2H_4$ | H | 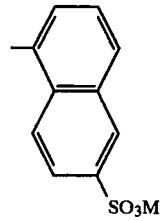 | H | 1/1 | | 280 |
| 16 | $tertC_4H_9$ | $tertC_4H_9$ | $C_2H_4$ | H | 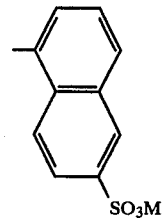 | Na | 1/1 | | |
| 17 | $(tertC_4H_9)_2$ | $(tertC_4H_9)_2$ | $(C_2H_4)_2$ | $(H)_2$ | 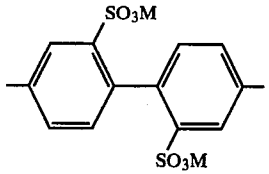 | H | 2/2 | | 260 |
| 18 | $tertC_4H_9$ | $tertC_4H_9$ | $C_2H_4$ | $CH_3$ | $-CH_2-CH_2-SO_3M$ | H | 1/1 | 224 | 276 |
| 19 | $tertC_4H_9$ | $tertC_4H_9$ | $C_2H_4$ | $CH_3$ | $-CH_2-CH_2-SO_3M$ | Na | 1/1 | | |
| 20 | $tertC_4H_9$ | $tertC_4H_9$ | $C_2H_4$ | H | 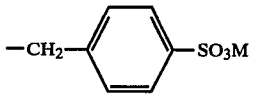 | H | 1/1 | | 273 |
| 21 | $tertC_4H_9$ | $tertC_4H_9$ | — | H | 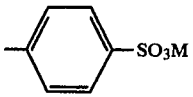 | H | 1/1 | | 280 |

TABLE 1-continued
| Compound No. | R | $R_1$ | X | $R_4$ | Z-$SO_3M$ | M | m/n | m.p. °C. | $\lambda_{max}$ nm |
|---|---|---|---|---|---|---|---|---|---|
| 22 | $tertC_4H_9$ | $tertC_4H_9$ | NH | H | 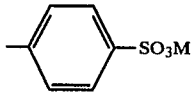 | Na | 1/1 | | |
| 23 | $tertC_4H_9$ | $tertC_4H_9$ | $CH_2$ | H | 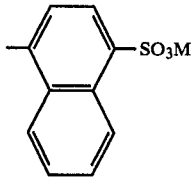 | H | 1/1 | >210-220 | |
| 24 | $tertC_4H_9$ | $tertC_4H_9$ | $CH_2$ | H | 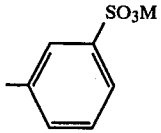 | H | 1/1 | >250 | |
| 25 | $tertC_4H_9$ | $tertC_4H_9$ | $C_2H_4$ | H | 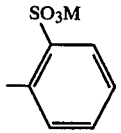 | H | 1/1 | >180 | |
| 26 | $tertC_4H_9$ | $tertC_4H_9$ | $C_2H_4$ | H | 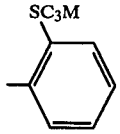 | 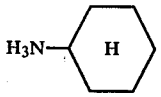 | 1/1 | 210 | |
| 27 | $tertC_4H_9$ | $tertC_4H_9$ | NH | H | 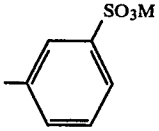 | H | 1/1 | | |

TABLE 1-continued
| Compound No. | R | $R_1$ | X | $R_4$ | Z-$SO_3M$ | M | m/n | m.p. °C. | $\lambda_{max}$ nm |
|---|---|---|---|---|---|---|---|---|---|
| 28 | $tertC_4H_9$ | $tertC_4H_9$ | NH | H | 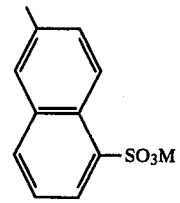 | 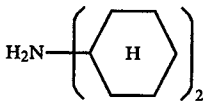 | 1/1 | | |
| 29 | $tertC_4H_9$ | $tertC_4H_9$ | $C_2H_4$ | H | $-CH_2-CH_2-SO_3M$ | H | 1/1 | 240 | |
| 30 | $(tertC_4H_9)_2$ | $(tertC_4H_9)_2$ | $(C_2H_4)_2$ | $(H)_2$ | 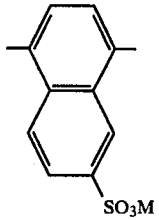 | H | 1/2 | 192 | |
| 31 | $tertC_4H_9$ | $tertC_4H_9$ | $C_2H_4$ | H | 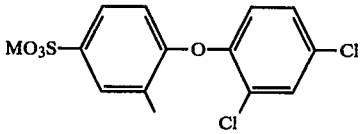 | H | 1/1 | 142 | |
| 32 | $tertC_4H_9$ | $tertC_4H_9$ | $C_2H_4$ | H | 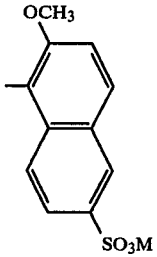 | H | 1/1 | 185 | |

TABLE 1-continued
| Compound No. | R | $R_1$ | X | $R_4$ | Z-$SO_3M$ | M | m/n | m.p. °C. | $\lambda_{max}$ nm |
|---|---|---|---|---|---|---|---|---|---|
| 33 | $tertC_4H_9$ | $tertC_4H_9$ | $C_2H_4$ | H | 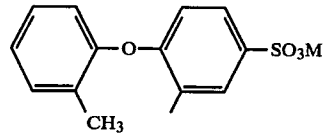 | H | 1/1 | | |
| 34 | $tertC_4H_9$ | $tertC_4H_9$ | $C_2H_4$ | H | 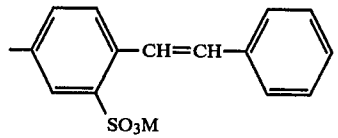 | H | 1/1 | >300 | |
| 35 | $tertC_4H_9$ | $tertC_4H_9$ | NH | $CH_3$ | $-CH_2-CH_2-SO_3M$ | H | 1/1 | | |
| 36 | $tertC_4H_9$ | $tertC_4H_9$ | NH | H | $-CH_2-CH_2-SO_3M$ | 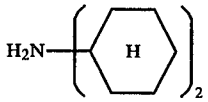 | 1/1 | 153–155 | |
| 37 | $tertC_4H_9$ | $tertC_4H_9$ | $C_2H_4$ | H | 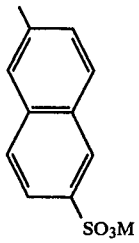 | H | 1/1 | >250 | |
| 38 | $tertC_4H_9$ | $tertC_4H_9$ | $C_2H_4$ | H | 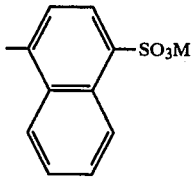 | H | 1/1 | 208 | |

TABLE 1-continued
| Compound No. | R | $R_1$ | X | $R_4$ | Z-$SO_3M$ | M | m/n | m.p. °C. | $\lambda_{max}$ nm |
|---|---|---|---|---|---|---|---|---|---|
| 39 | $tertC_4H_9$ | $tertC_4H_9$ | $CH_2$ | H | 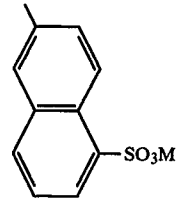 | H | 1/1 | >210 | |
| 40 | $tertC_4H_9$ | $tertC_4H_9$ | $C_2H_4$ | H | 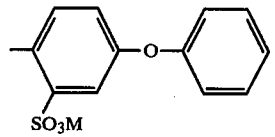 | H | 1/1 | >200 | |
| 41 | $tertC_4H_9$ | $tertC_4H_9$ | $C_2H_4$ | $C_2H_5$ | 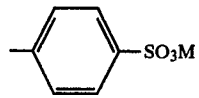 | H | 1/1 | 180 | |
| 42 | $tertC_4H_9$ | $tertC_4H_9$ | $C_2H_4$ | H | 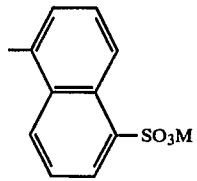 | H | 1/1 | 204 | |
| 43 | $isoC_3H_7$ | $isoC_3H_7$ | $C_2H_4$ | H | 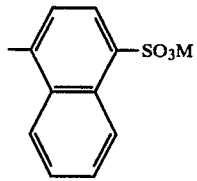 | H | 1/1 | 210 | |
| 44 | $tertC_4H_9$ | $tertC_4H_9$ | — | H | 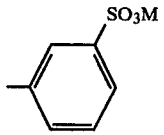 | Na | 1/1 | | |

TABLE 1-continued
| Compound No. | R | $R_1$ | X | $R_4$ | Z-$SO_3M$ | M | m/n | m.p. °C. | $\lambda_{max}$ nm |
|---|---|---|---|---|---|---|---|---|---|
| 45 | tert$C_4H_9$ | $CH(CH_3)C_6H_5$ | $C_2H_4$ | H | 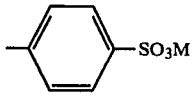 | Na | 1/1 | | 320 |
| 46 | tert$C_4H_9$ | tert$C_4H_9$ | $C_2H_4$ | $CH_3$ | 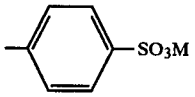 | Na | 1/1 | | 272 |

and the compounds of the formulae

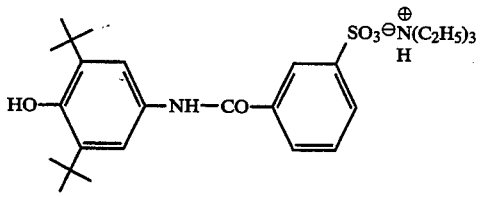

(47)

$\lambda_{max}$284 nm and

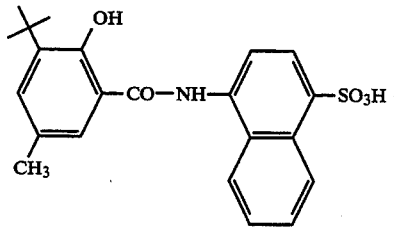

(48)

m.p. 190° C.

The compounds of formula (1) can be applied in per se known manner to the polyamide fibre material. It is preferred to apply the compound of formula (1) by spraying or padding with an aqueous solution containing said compound of formula (1) to give a coatingh concentration of 0.01 to 10% by weight, preferably of 0.25 to 3% by weight, or to treat the goods in an aqueous bath containing the compounds in a concentration of 0.01 to 10% by weight, preferably of 0.25 to 3 by weight.

Application of the compound of formula (1) can be made continuously or batchwise.

Application of water-soluble phenolic antioxidant is always made before the heating process, dyeing, and the like.

In the process of this invention it is preferred to treat yarns of polyamide fibre material.

The dyeing step of this invention is carried out in a manner known per se.

The liquor to goods ratio in dyeing by the exhaust process can be chosen within a wide range, conveniently from 1:3 to 1:100 and preferably 1:10 to 1:40. The process is expediently carried out in the temperature range from 30° to 130° C., preferably from 50° to 95° C.

The amount of liquor applied in the continuous process is conveniently 40–700% by weight, preferably 40–500% by weight. The fibre material is then subjected to a heat treatment to fix the dyes applied. Fixation can also be carried out by the cold pad-batch method.

The heat treatment for fixing the dyes is preferably carried out by a steaming process by treatment in a steamer using steam or superheated steam in the temperature range from 98° to 105° C. for typically 1 to 7, preferably 1 to 5, minutes. Dye fixation by the cold pad-batch method can be carried out by storing the impregnated and preferably rolled-up material at room temperature (15° to 30° C.), conveniently for 3 to 24 hours, the batching time being dependent on the dye, as those skilled in the art will know.

After completion of the dyeing process and fixation, the resultant dyeings are washed in conventional manner and dried.

Dyeings of good heat and/or photochemical stability are obtained by the inventive process.

Dyeings to be stabilised in the practice of this invention are those which are produced by disperse, acid or metal complex dyes, preferably azo, anthraquinone, 1:2 metal complex dyes, typically 1:2 chromium, 1:2 cobalt complex dyes or copper complex dyes.

Examples of these dyes are described in the Colour Index, 3rd edition, 197 1, Volume 4.

Polyamide materials will be understood as meaning synthetic polyamide, including nylon 6, nylon 66 and nylon 12, and modified polyamide, typically low dyeing, regular or deep dyeing type polyamide or basic dyeable polyamide. In addition to pure polyamide fibres, it is also preferred to use polyurethane/polyamide blends, typically polyamide/polyurethane tricot fabric in a blend ratio of 70:30. In general, the pure or blended polyamide material may be in a wide range of presentation, conveniently as fibre, yarn, woven, knitted, nonwoven or pile fabric. Yarn is preferred.

The polyamide material is dimensionally stabilised polyamide material, i.e. polyamide material treated by a moulding process, a shaping process, which is carried out briefly at elevated temperature (e.g. brassière manufacture).

The invention is illustrated by the following Examples in which parts and percentages are by weight.

In the Examples, yarns A, B and C have the following meanings: yarn A: untreated and unstabilised (unfixed) polyamide 66 yarn (deep dyeing type); yarn B: untreated polyamide 66 yarn (deep dyeing type) which has been dimensionally stabilised (fixed) by a standard continuous pressure/saturated steam process at 132° C./2 atmospheres; yarn C: a polyamide 66 yarn (deep dyeing type) which has been sprayed with 20% by weight of an aqueous liquor containing 40 g per liter of water of the compound of formula

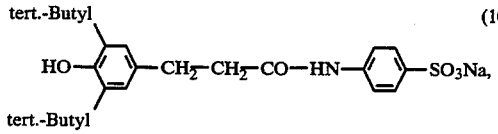

(101)

the pH of which liquor has been adjusted to pH 5.3 with citric acid, and which has subsequently been dimensionally stabilised by a standard continuous pressure/-saturated steam process at 132° C./2 atmospheres.

Example 1

A 10 g sample of each of yarns A and C (dye liquors 1 and 3) and two 10 g samples of yarn B (dye liquors 2 and 4) are prepared. These 4 samples are dyed in an ®AHIBA dyeing machine at a liquor ratio of 1:25. For all 4 dyeing a liquor is prepared that contains 1% by weight of acetic acid (80%), 0.5 g/l of sodium acetate as well as 2% by weight of a dyeing assistant ®(Albegal SW). The liquors additionally contain 0.13% of the yellow dyeing dye which in the form of the free acid is of formula

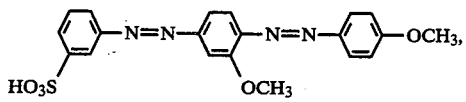

(102)

0.09% by weight of the red dyeing dye which in the form of the free acid is of formula

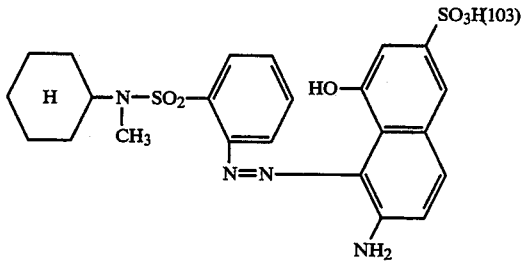

(103)

and 0.1% by weight of the blue dyeing dye which in the form of the free acid is of formula

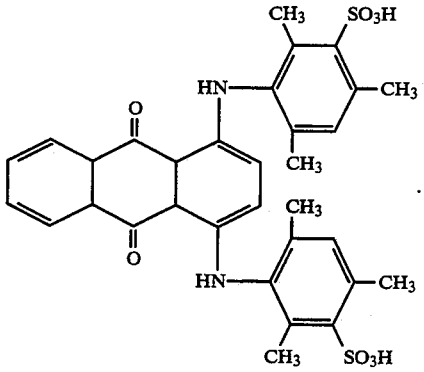

(104)

All dyes are added to the liquor as aqueous stock solution. Dye liquors 1, 2 and 3 contain no further ingredients, whereas liquor 4 additionally contains 0.8% by weight of the compound of formula

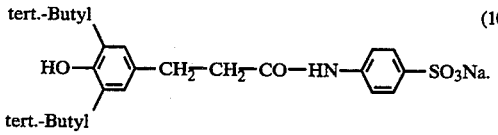

(101)

Dyeing is commenced at 30° C. and the liquor is then heated to 95° C. at a rate of 2.5° C./minute. After a dyeing time of 30 minutes at 95° C., the liquor is cooled to 50° C. and the dyeing are then rinsed with cold water, centrifuged and subsequently dried. The dyeings are tested for their lightfastness properties in accordance with SN-ISO 105-BO2 (xenon light) and DIN 75202 (Fakra). The following results are obtained:

| | Results: Lightfastness | | |
|---|---|---|---|
| Dyeing | XENON | FAKRA 65 h | FAKRA 130 h |
| 1 | −6 | 2–3 | 1* |
| 2 | 5–6 | 2 | 1* |
| 3 | 6 | 4 | 2–3 |
| 4 | 5–6 | 3 | 2 |

*Yarn is no longer tear resistant

It is evident from these results that compound (101) imparts photochemical as well as thermal protection to the dyeing. The lightfastness properties are tested in accordance with SN-ISO 105-BO2 (xenon light) and DIN 75202 (Fakra) [for 65 and 130 hours]. The results show that yarn C [dimensionally stabilised and treated with compound (101) before fixation] has the best lightfastness. Application from dye liquor 4 with subsequent application of the compound of formula (101) to the already dimensionally stabilised yarn also give good results which do not, however, approach those obtained by treating the yarn with the compound of formula (101) before fixation (dimensional stabilisation).

Example 2

4 yarn samples are prepared as described in Example 1. These are dyed in 4 dye liquors of the following composition. All dye liquors contain 0.25 g/l of monosodium phosphate, 2.0 g/l of disodium phosphate and 2% by weight of the dyeing assistant used in Example 1. The following dyes, dissolved in water, are added to the dye liquors: 0.4% by weight of the grey dyeing mixture consisting of 81 parts of the dye of formula

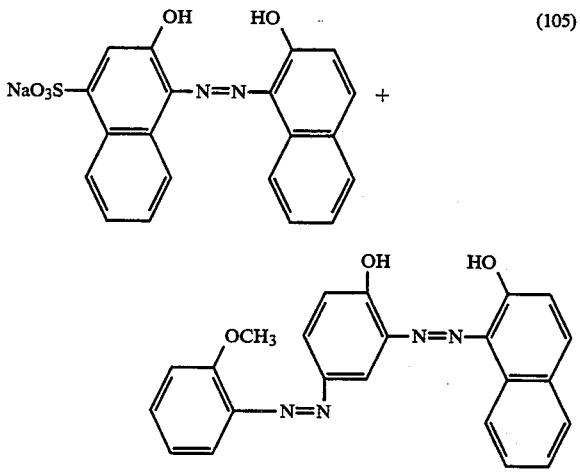

(105)

1:2 Cr complex and 12 parts of the dye of formula

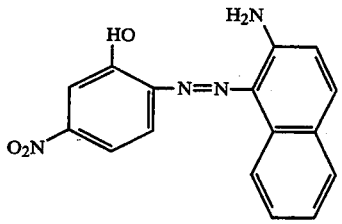

1:2 Co complex and 0.002% of the bordeaux dyeing dye of formula

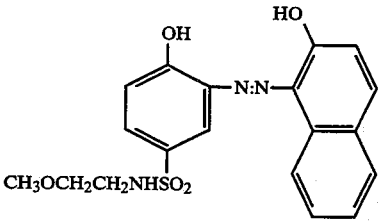

(106)

1:2 Co complex.

The dye liquor contains 0.8% by weight of the compound of formula (101). Dyeing is carried out as described in Example 1, except that 0.5% by weight of acetic acid (80%) is added 15 minutes after the temperature has reached 95° C.

The dyeings are tested for their lightfastness in accordance with SN-ISO 105-BO2 (xenon light) and DIN 75202 (Fakra). The following results are obtained:

| | Results: Lightfastness | | |
|---|---|---|---|
| Dyeing | XENON | FAKRA 65 h | FAKRA 130 h |
| 1 | 7–8 | 2–3 H | 1* |
| 2 | 7 | 2 H | 1* |
| 3 | 7–8 | 5 | 4–5 |
| 4 | 7–8 | 4–5 | 4 |

*yarn is no longer tear resistant

It is evident from these results that compound (101) imparts photochemical as well as thermal protection to the dyeing. The lightfastness properties are tested in accordance with SN-ISO 105-BO2 (xenon light) and DIN 75202 (Fakra) [for 65 and 130 hours]. The results show that yarn C [dimensionally stabilised and treated with compound (101) before fixation] has the best lightfastness. Application from dye liquor 4 with subsequent application of the compound of formula (101) to the already dimensionally stabilised yarn also give good results which dot not, however, approach those obtained by treating the yarn with the compound of formula (101) before fixation (dimensional stabilisation).

Examples 3–5

The procedure is carried out as described in Example 1 or 2, replacing the compound of formula (101) with the equivalent amount of the following compounds to five comparable results.

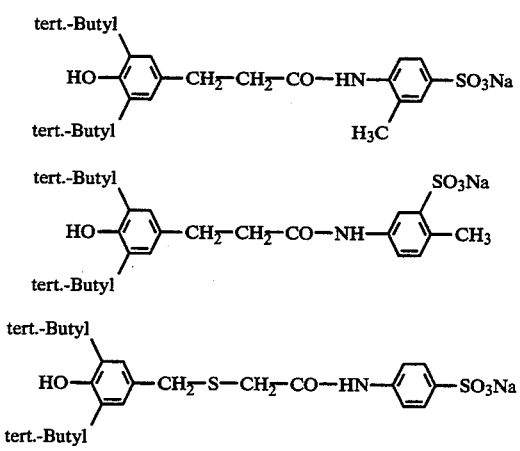

What is claimed is:

1. A process for enhancing the thermal and/or photochemical stability of dyeings on dimensionally stabilised polyamide fibres, which comprises treating the polyamide fibre material, before the fixation step for producing defined, resilient forms and dimensions, from aqueous medium with a compound of formula I $$(A—Y—)_nZ(—W)_m \quad (1)$$

wherein

A is the radical of a sterically hindered phenol of the benzene series,

Y is a radical of formulae (2) or (3)

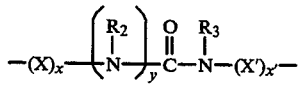

(2)

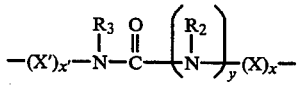

(3)

wherein

X and X′ are each independently of the other alkylene, oxaalkylene or thiaalkylene, $R_2$ and $R_3$ are each independently of the other hydrogen or an unsubstituted or substituted alkyl group, and x, x′ and y are each independently of one another 0 or 1, Z is an aliphatic or a carbocyclic aromatic radical, which last mentioned radical contains not more than two mono- or bicyclic nuclei, W is the sulfo group, and m and n are each independently of the other 1 or 2, or a water-soluble salt thereof, from aqueous medium.

2. A process according to claim 1, which comprises the use of a compound of formula (1), wherein A is a monohydroxyphenyl radical in which at least one o-position relative to the hydroxyl group is substituted by alkyl of 1 to 12 carbon atoms, cycloalkyl of 6 to 10 carbon atoms or aralkyl of 7 to 10 carbon atoms, and which is further unsubstituted or carries further substituents.

3. A process according to claim 1, which comprises the use of a compound of formula (1), wherein A is a radical of formula (4)

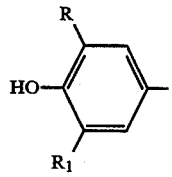

(4)

wherein R and $R_1$ are each independently of the other hydrogen, methyl or tert-butyl, and the sum of the carbon atoms of R and $R_1$ is at least 2.

4. A process according to claim 1, wherein X and X′ in the compounds of formulae (2) and (3) are straight-chain or branched alkylene of 1 to 8 carbon atoms.

5. A process according to claim 1, wherein $R_2$ and $R_3$ in the compounds of formulae (2) and (3) are straight-chain or branched $C_1$–$C_8$-alkyl.

6. A process according to claim 1, wherein $R_2$ and $R_3$ in the compounds of formulae (2) and (3) are hydroxyalkyl, alkoxyalkyl, aminoalkyl, alkylaminoalkyl or dialkylaminoalkyl, each containing a total of 2 to 10 carbon atoms, or are phenyl.

7. A process according to claim 1, wherein Y in formula (1) is a radical of formula (5)

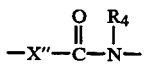

(5)

wherein $R_4$ is hydrogen or $C_1$–$C_4$alkyl and X″ is $C_1$–$C_4$alkylene.

8. A process according to claim 1, wherein Z in formula (1) is the radical of an unsubstituted or carboxy-substituted alkane containing at least 2 carbon atoms, the radical of a benzene nucleus which is unsubstituted or substituted by chloro or bromo, $C_1$–$C_4$alkyl, $C_1$–$C_4$alkoxy, $C_1$–$C_4$alkoxycarbonylamino, hydroxyl, carboxy, phenylethyl, styryl, phenyl, phenoxy, phenylthio, phenylsulfonyl or acylamino, and the group W is attached directly to said benzene nucleus or is attached to a monocyclic aryl radical of one of the substituents thereof, or is a naphthalene or tetraline radical.

9. A process according to claim 1, which comprises the use of a compound of formula (7)

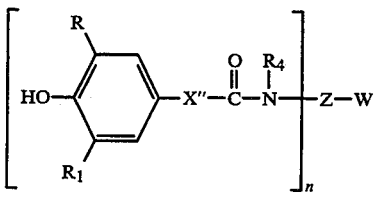

(7)

wherein R and $R_1$ are each independently of the other methyl or tert-butyl, $R_4$ is hydrogen of $C_1$–$C_4$alkyl, X″ is $C_1$–$C_4$alkylene, Z is ethylene, a di- or trivalent radical of benzene or naphthalene or a divalent radical of diphenyl ether, W is a sulfo group and n is 1 or 2.

10. A process according to claim 9, which comprises the use of a compound of formula (7), wherein R and $R_1$ are tert-butyl, X″ is methylene or ethylene, $R_4$ is hydrogen, methyl or ethyl and Z is ethylene, o-, m- or p-phenylene, 1,4-naphthylene, 1,8-naphthylene, 2-methoxy-1,6-naphthylene, 1,5-naphthylene, 2,5-naphthylene, 2,6-naphthylene, 1,4,6-naphthalenetriyl or a radical selected from

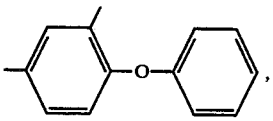

-continued

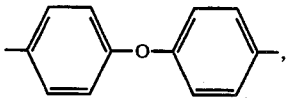

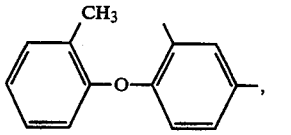

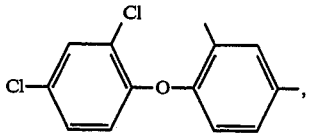

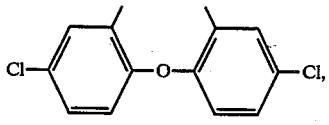

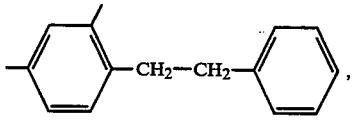

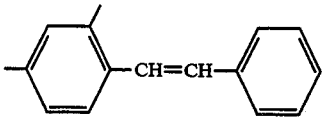

and

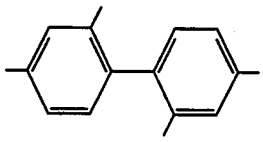

in which the sulfo group W may also be in the form of its alkali metal salts or ammonium salts.

11. A process according to claim 1, wherein the compound of formula (1) is applied to the fibres by the exhaust method or a continuous process.

12. A dyeing produced on polyamide fibre treated by the process as claimed in claim 1.

* * * * *